US007090488B2

(12) United States Patent
Murakami et al.

(10) Patent No.: US 7,090,488 B2
(45) Date of Patent: Aug. 15, 2006

(54) HEAT TREATMENT FURNACE

(75) Inventors: Motokazu Murakami, Tokyo (JP); Yoshiyuki Tanno, Tokyo (JP); Kazuaki Kawasaki, Tokyo (JP); Akihiro Nagaishi, Tokyo (JP); Hiroyoshi Suzuki, Tokyo (JP); Ken-ichi Kitamoto, Tokyo (JP)

(73) Assignee: Dowa Mining Co., Ltd., Tokyo (JP)

( * ) Notice: Subject to any disclaimer, the term of this patent is extended or adjusted under 35 U.S.C. 154(b) by 0 days.

(21) Appl. No.: 10/503,233

(22) PCT Filed: Mar. 27, 2002

(86) PCT No.: PCT/JP02/02977

§ 371 (c)(1),
(2), (4) Date: Aug. 2, 2004

(87) PCT Pub. No.: WO03/068997

PCT Pub. Date: Aug. 21, 2003

(65) Prior Publication Data

US 2005/0158685 A1 Jul. 21, 2005

(30) Foreign Application Priority Data

Feb. 12, 2002 (JP) ..... 2002-033555

(51) Int. Cl.
*F27B 9/02* (2006.01)

(52) U.S. Cl. ..... 432/128

(58) Field of Classification Search ..... 432/128, 432/126, 133, 137

See application file for complete search history.

(56) References Cited

U.S. PATENT DOCUMENTS

| | | | | | |
|---|---|---|---|---|---|
| 3,778,221 | A | * | 12/1973 | Bloom | 432/11 |
| 4,421,481 | A | * | 12/1983 | Holz et al. | 432/239 |
| 4,627,814 | A | * | 12/1986 | Hattori et al. | 432/128 |
| 4,932,864 | A | * | 6/1990 | Miyabe | 432/128 |
| 4,966,547 | A | * | 10/1990 | Okuyama et al. | 432/9 |
| 5,443,383 | A | * | 8/1995 | Kuehn | 432/122 |
| 6,530,780 | B1 | * | 3/2003 | Mori et al. | 432/121 |

FOREIGN PATENT DOCUMENTS

| | | |
|---|---|---|
| JP | 61-16912 | 5/1986 |
| JP | 3-281771 | 12/1991 |
| JP | 6-330153 | 11/1994 |
| JP | 2001-207253 | 7/2001 |

OTHER PUBLICATIONS

English Language Abstract of JP. 61-16912; JP 3-281771; 6-330153 and 21-207253 Copy of International Search Report.

* cited by examiner

*Primary Examiner*—Gregory Wilson
(74) *Attorney, Agent, or Firm*—Michael Bednarek; Pillsbury Winthrop Shaw Pittman LLP

(57) ABSTRACT

A heating zone (4), a cooling zone (5), and a quenching zone (6) are provided inside a linear furnace body in this order, the heating zone (4), the cooling zone (5), and the quenching zone (6) being separated by partition doors (2, 3). Conveying means of a work (W) is a tray pusher (7) in the heating zone (4) and conveying means of the work (W) is roller hearths (8, 9) in the cooling zone (5) and the quenching zone (6), the roller hearths (8, 9) being independently driven.

5 Claims, 7 Drawing Sheets

HEAT TREATMENT FURNACE

TECHNICAL FIELD

The present invention relates to metal heating in various atmospheres, and more particularly, to a heat treatment furnace that can be effectively used for continuous gas carburizing.

BACKGROUND ART

Referring to FIG. 16, a straight continuous gas carburizing furnace 1A of a known type includes a preheating zone 4*a* and a carburizing diffusion zone 4*b*, which are collectively referred to as a heating zone 4 in the following description, a cooling zone 5, and a quenching zone 6. The heating zone 4, the cooling zone 5, and the quenching zone 6 are not separated by partition doors but are integrated. The heating zone 4, the cooling zone 5, and the quenching zone 6 have a temperature gradient therebetween.

More specifically, after being heated in the heating zone 4, a work W is cooled down to a quenching temperature in the cooling zone 5, which is continuous with the heating zone 4, and is retained in the quenching zone 6, which is continuous with the cooling zone 5, for a predetermined period of time in accordance with a carburizing cycle. Consequently, variation in temperature distribution in the furnace is large due to the on-off operation of a heater and also the temperature at the front of a tray differs from the temperature at the rear of the tray so that quality control of the work W is difficult.

In FIG. 16, 7 denotes a tray pusher, 20 denotes a quench oil tank, 21 denotes an entrance door, 22 denotes an exit door, and 32 denotes an inlet chamber (these reference numerals also refer to the same components in the following drawings and description).

The applicant proposed the provision of a separate chamber functioning as a cooling and quenching zone in the aforementioned known integrated type furnace. That is, as shown in FIG. 18, a continuous gas carburizing furnace 1B includes a cooling and quenching zone 6 which is disposed at the rear end of the heating zone 4 and is separated from the heating zone 4 by a partition door 2 to serve as a separate chamber (see Japanese Examined Patent Application Publication No. 62-21866).

With the continuous gas carburizing furnace 1B, a tray pusher 7 pushes a work from an inlet chamber 32 into the heating zone 4 and the work undergoes predetermined heating therein. After that, a side pusher 26 pushes the work to open the partition door 2, which is disposed between the heating zone 4 and the cooling and quenching zone 6 separated from the heating zone 4. Then, the work is transferred to the cooling and quenching zone 6, which is separated from the heating zone 4, and is cooled to and held at a quenching temperature therein during one carburizing cycle. After that, the work is moved to the quench oil tank 20 by an extracting pusher 27 and is quenched regardless of the carburizing cycle.

Unlike the straight continuous gas carburizing furnace 1A, the continuous gas carburizing furnace 1B includes the cooling and quenching zone 6, which is separated from the heating zone 4, so that the work is free from the influences of the temperatures of the works situated in front of or behind it, leading to a great improvement in quenching temperature distribution. Furthermore, the concentration of carbon can be separately controlled in the cooling and quenching zone 6, thereby greatly improving control over the concentration in the atmosphere. Hence, the quality of the work is improved.

Furthermore, unlike the straight continuous gas carburizing furnace 1A, according to the continuous gas carburizing furnace 1B, two doors will not open simultaneously so that any change in the pressure in the furnace is small. Furthermore, immediately after the temperature reaches the cooling temperature, the work is quenched (zero quench), whereby distortion of the work is minimized.

Furthermore, unlike the straight continuous gas carburizing furnace 1A, according to the continuous gas carburizing furnace 1B, it is not necessary to hold the work in the cooling zone 5, which is continuous with the heating zone 4, in order that the temperature of the work is decreased to the quenching temperature, thus reducing the time during which the work is retained in the cooling zone 5. Accordingly, the overall heating time is drastically reduced which, in turn, reduces the heating energy and atmospheric gas. As a consequence, cost reduction is accomplished, exhibiting good economic effects.

Unfortunately, according to the continuous gas carburizing furnace 1B, the cooling and quenching zone 6 is disposed at the rear end of the heating zone 4 as a separate chamber. Moreover, the continuous gas carburizing furnace 1B requires the side pusher 26, the extracting pusher 27 and the like besides the tray pusher 7 and thus has a complicated structure, thereby requiring a larger installation space.

Another furnace is proposed (Japanese Examined Patent Application Publication No. 61-16912). In this furnace, a heating chamber, a carburizing chamber, and a cooling and holding chamber are separated by partition doors and a work is conveyed by roller hearths which are separately provided at the respective chamber. However, such a furnace that employs only the roller hearths to convey the work in the furnace is larger than the tray-pusher type furnace. Furthermore, with this type of furnace, loss of heating energy due to heat dissipation is large, resulting in increased cost.

It is an object of the present invention to provide a heat treatment furnace which exhibits not only various advantages achieved by the continuous gas carburizing furnace 1B or the like but also a shorter lead time (the time during which a work is retained in the furnace) than the straight continuous gas carburizing furnace 1A. Furthermore, the heat treatment furnace of the present invention has a simpler structure as compared to the continuous gas carburizing furnace 1B or the like and requires a reduced installation space.

DISCLOSURE OF INVENTION

In the heat treatment furnace according to the present invention, a heating zone, a cooling zone, and a quenching zone are provided inside a linear furnace body in this order, the heating zone, the cooling zone, and the quenching zone being separated by partition doors. Conveying means of a work is a tray pusher in the heating zone and conveying means of the work is roller hearths in the cooling zone and the quenching zone, the roller hearths being independently driven.

According to the heat treatment furnace of the present invention, the conveying means of the work is the tray pusher in the heating zone so that there is no space between trays. Therefore, the heat treatment furnace of the present invention is compact as compared to the case where the roller hearth is employed as conveying means.

Moreover, when the roller hearth is the conveying means of the work in the heating zone, a bearing of each roller hearth is disposed outside the furnace so that heat is dissipated outside the furnace. According to the present invention, however, the tray pusher is the conveying means of the work in the heating zone so that heat dissipation outside the furnace does not occur, unlike the case where the roller hearth is used as conveying means, leading to effective utilization of heating energy.

Furthermore, according to the present invention, conveying means of the work is roller hearths in the cooling zone and the quenching zone and these roller hearths are independently driven. Due to this structure, cooling and quenching are performed irrespective of the carburizing cycle in the heating zone. Therefore, the lead time (the time during which a work is retained in the furnace) is reduced as compared to the known straight continuous gas carburizing furnace 1A. Desirably, the roller hearths in the cooling zone and the quenching zone can be turned forward and backward.

According to a preferable embodiment, a front end of the roller hearth belonging to the cooling zone resides inside the heating zone at the rear end of the heating zone.

When the furnace is constructed as described above, posterior to the completion of the carburizing diffusion treatment in the heating zone, the foremost work is transferred to the cooling zone and the subsequent work remains in the heating zone at an exact predetermined position.

According to a preferable embodiment, the front end of the roller hearth, which belongs to the cooling zone, resides inside the heating zone by the length of one block of the work from the partition door, which separates the heating zone from the cooling zone, and a rear end of a work conveyor rail provided in the heating zone is connected to the front end of the roller hearth in order to convey the work. Therefore, the roller hearth provided in the cooling zone is minimized in the heating zone, thereby reducing the length of the furnace.

According to a preferable embodiment, work-detecting sensors are provided inside the heating zone, the cooling zone, and the quenching zone, respectively.

Since the furnace is constructed as described above, the work-detecting sensors confirm the existence of the work in the heating zone, the cooling zone, and the quenching zone so that automatic conveyance of the work is conducted precisely and safely between the zones.

According to a preferable embodiment, a wall of the furnace body has a layered structure including, from inside, a brick, a silica board, and a compact composed of silica, titanium oxide, and inorganic fiber.

Since the furnace is constructed as described above, a heat insulating effect of the wall of the furnace is improved so that heat dissipation from the surface of the furnace is reduced, which, in turn, reduces heating energy, leading to good economic effect.

BEST MODE FOR CARRYING OUT THE INVENTION

Figure 1:
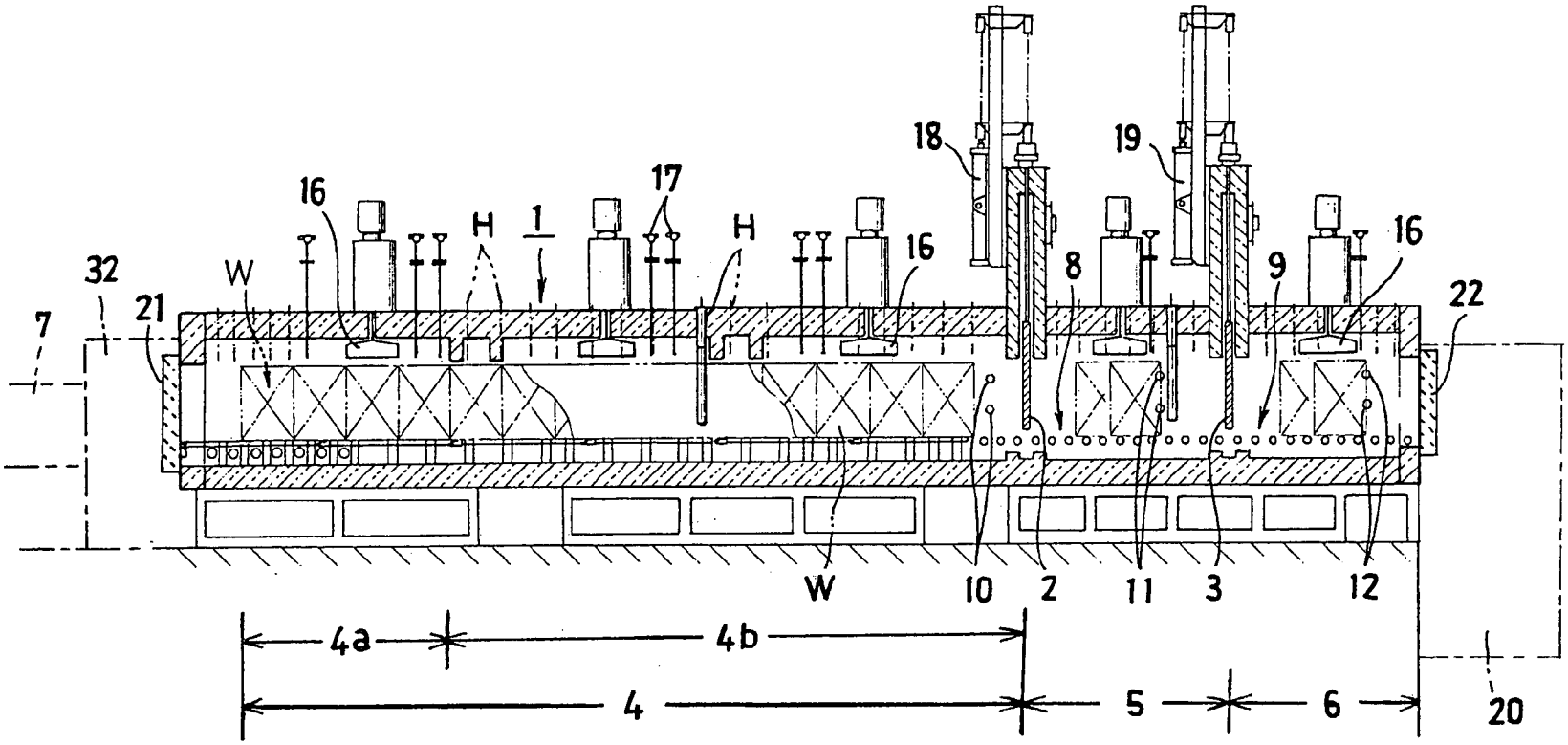
FIG. 1 is a side cross-sectional view of a heat treatment furnace according to an embodiment of the present invention.
Figure 2:
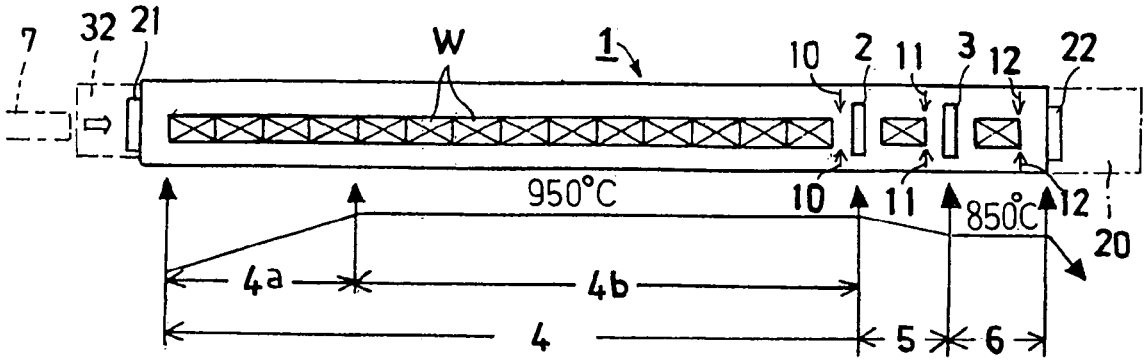
FIG. 2 is a schematic plan view of the heat treatment furnace according to the embodiment of the present invention with a temperature gradient curve for carburizing.

As shown in FIGS. 1 and 2, a heat treatment furnace 1 according to an embodiment of the present invention includes a preheating zone 4*a* and a carburizing diffusion zone 4*b*, which are simply referred to as a heating zone 4 in the following description, a cooling zone 5, and a quenching zone 6 in this order inside a linear furnace body, the heating zone 4, the cooling zone 5, and the quenching zone 6 being separated by partition doors 2 and 3. A work W on a tray is conveyed by a tray pusher 7 in the heating zone 4, by a roller hearth 8 in the cooling zone 5, and by a roller hearth 9 in the quenching zone 6, the roller hearth 8 and the roller hearth 9 being separately driven. According to the embodiment, the front end of the roller hearth 8 belonging to the cooling zone 5 resides inside the heating zone 4 at the rear end of the heating zone 4.

Furthermore, the heating zone 4, the cooling zone 5, and the quenching zone 6 are provided with optical work-detecting sensors 10, 11, and 12, respectively. The optical work-detecting sensors 10, 11, and 12 are composed of light-projecting elements and light-receiving elements that are disposed on both sides of conveying means for the work W so as to face each other. Alternatively, standby light-projecting elements and light-receiving elements may be further provided so as to face each other. A plurality of light-projecting elements and light-receiving elements may be disposed at one position to face each other, as necessary.

In FIG. 1, 16 denotes a mixing fan, 17 denotes a thermocouple, 18 denotes an opening and closing device for the partition door 2, 19 denotes an opening and closing device for the partition door 3, and H denotes a heater.

Figure 3:
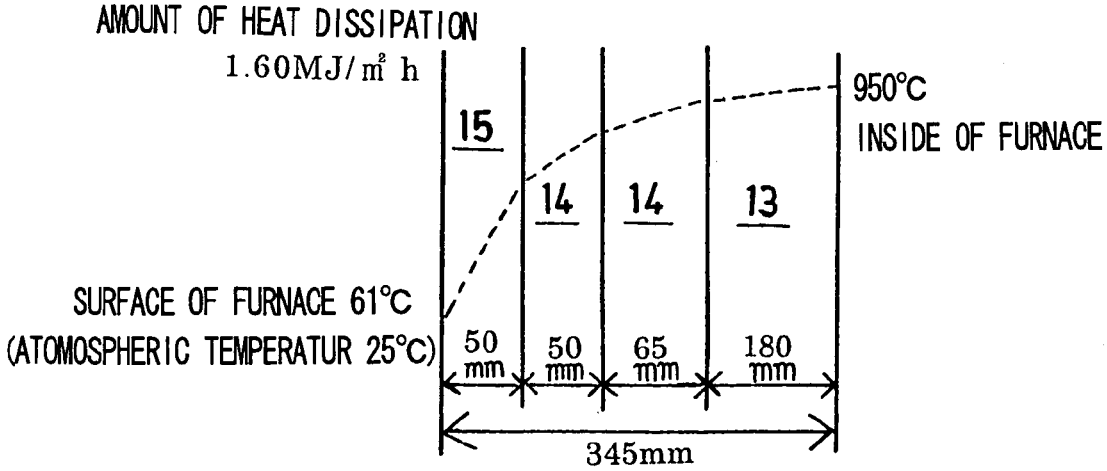
FIG. 3 is a structural drawing of a wall of the heat treatment furnace according to the embodiment of the present invention with a thermal-insulation temperature curve.

As shown in FIG. 3, a heat insulator for the furnace body of the heat treatment furnace 1 has a layered structure including, from inside, a brick 13, a silica board 14, and a compact 15 composed of silica, titanium oxide, and inorganic fiber.

The thickness in FIG. 3 is represented by millimeter (mm). The overall thickness of the heat insulator is 345 mm. The thermal-insulation temperature curve shows that when the temperature of the furnace is maintained at 950° C., the surface temperature of the furnace body 1 is 61° C. (atmospheric temperature: 25° C.) and the amount of heat dissipation is 1.60 $MJ/m^2h$.

Figure 17:
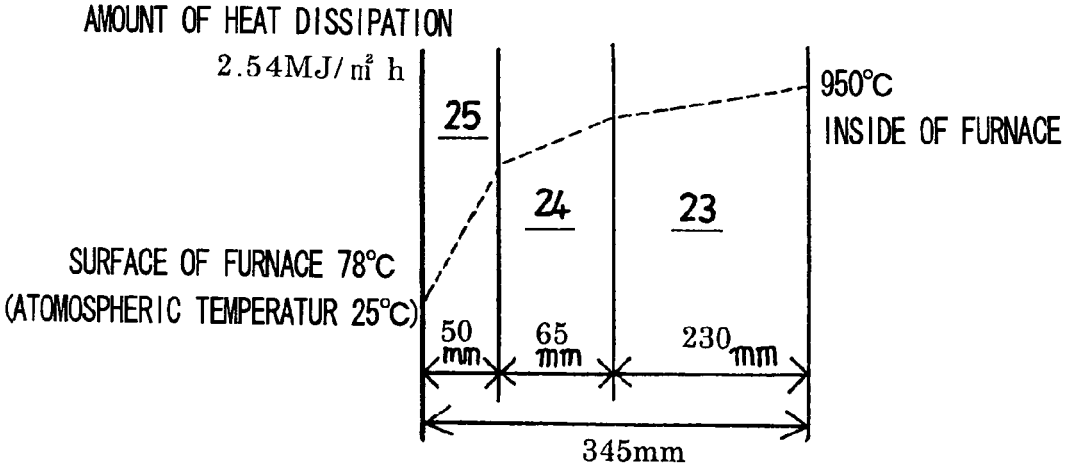
FIG. 17 is a structural drawing of a wall of the known straight continuous gas carburizing furnace with a thermal-insulation temperature curve.
Figure 18:
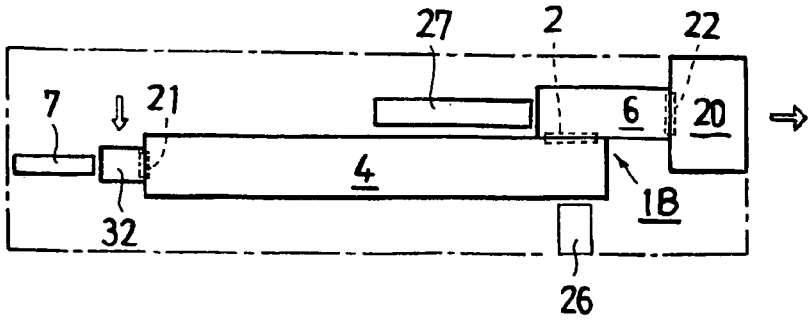
FIG. 18 is a plan view of a continuous gas carburizing furnace proposed by the present applicant.

As shown in FIG. 17, a heat insulator for the furnace body of the known straight continuous gas carburizing furnace 1A has a layered structure including a brick 23, a silica board 24, and a silica board 25 from inside.

The thickness in FIG. 17 is represented by millimeter (mm). The overall thickness of the heat insulator is 345 mm. The thermal-insulation temperature curve shows that when the temperature of the furnace is maintained at 950° C., the surface temperature of the furnace body 1 is 78° C. (atmospheric temperature: 25° C.) and the amount of heat dissipation is 2.54 $MJ/m^2h$.

Comparison of the amount of heat dissipation of the furnace according to the embodiment of the present invention shown in FIG. 3 and that of the known furnace shown in FIG. 17 shows that 2.54 $MJ/m^2h-1.60$ $MJ/m^2h=0.94$ $MJ/m^2h$. That is, the furnace of the present embodiment achieves an energy reduction of 0.94 $MJ/m^2h$ (0.26 $Kwh/m^2$).

Next, the reduction in lead time (the time during which a work is retained in the furnace) accomplished by the heat treatment furnace 1 of the present embodiment shown in FIGS. 1 and 2 will now be described by comparing the heat treatment furnace 1 with the known straight continuous gas carburizing furnace 1A shown in FIG. 16.

Figure 16:
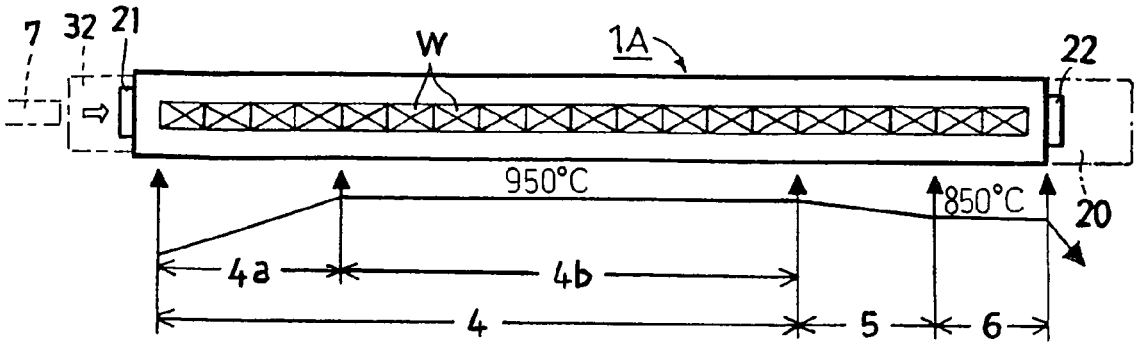
FIG. 16 is a schematic plan view of a known straight continuous gas carburizing furnace with a temperature gradient curve for carburizing.

According to the known straight continuous gas carburizing furnace 1A shown in FIG. 16, 14 trays each of which holds a plurality of works W are retained in the heating zone 4, three trays are retained in the cooling zone 5, and two trays are retained in the quenching zone 6. A total of 19 trays are retained in the furnace.

On the other hand, according to the heat treatment furnace 1 of the present embodiment, as shown in FIG. 2, 14 trays each of which holds the work W are retained in the heating zone 4, similar to the known straight continuous gas carburizing furnace 1A shown in FIG. 16, and a single tray is retained in each of the cooling zone 5 and the quenching zone 6. Therefore, the heat treatment furnace 1 retains a total of 16 trays. According to the heat treatment furnace 1, a temperature gradient exists between the cooling zone 5 and the quenching zone 6 which are separated by the partition door 2 and the partition door 3.

The reduction ratio of the lead times of these two furnaces is calculated to be (19−16)/16=0.1875. That is, the furnace of the present embodiment reduces the lead time by approximately 19% as compared to the known furnace in FIG. 16. More specifically, assuming that the furnace cycles of the heat treatment furnace 1 and the straight continuous gas carburizing furnace 1A are each 15 minutes, for example, the lead time for the known straight continuous gas carburizing furnace 1A is 285 min (15 min×19 trays=285 min), whereas the lead time for the heat treatment furnace 1 of the present embodiment is 240 min (15 min×16 trays=240 min). Thus, with the heat treatment furnace 1, the lead time is reduced by 45 min (285 min−240 min=45 min).

Next, the actual carburizing steps in the heat treatment furnace 1 of the present embodiment shown in FIGS. 1 and 2 will now be described by referring to FIGS. 4 to 15.

Figure 4:
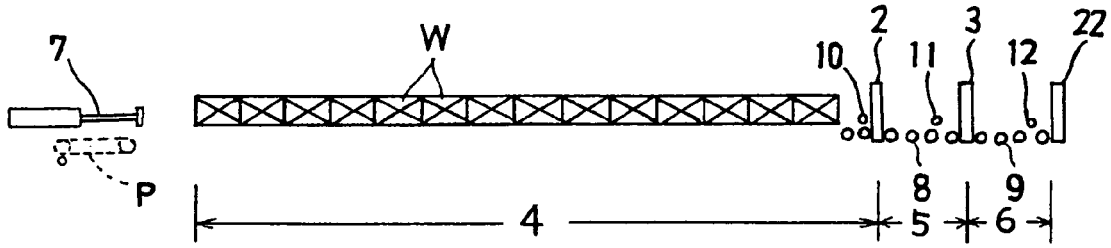
FIGS. 4 to 15 are schematic side views of carburizing steps using the heat treatment furnace according to the embodiment of the present invention.

Referring to FIG. 4, after seasoning is completed, the work W (tray) is supplied into the heating zone 4 and is heated to 950° C. so that carburizing diffusion treatment (simply referred to as carburizing hereinbelow) is performed on the work W.

Figure 5:
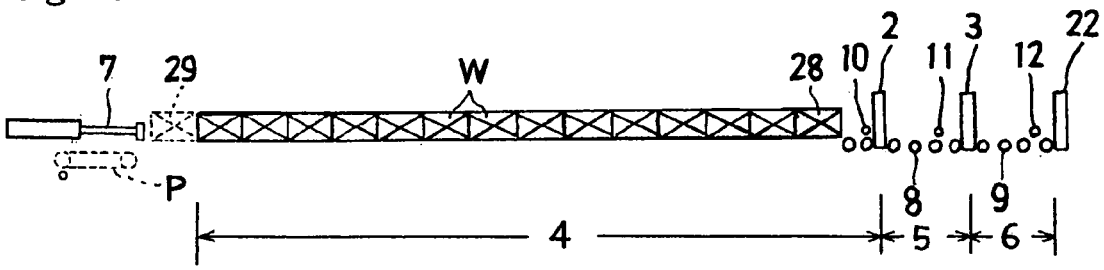

Referring to FIG. 5, while carburizing of the work W proceeds in the heating zone 4, carburizing of a foremost work 28 is completed in the heating zone 4 and a new work 29 will be supplied into the heating zone 4 by the tray pusher 7.

Figure 6:
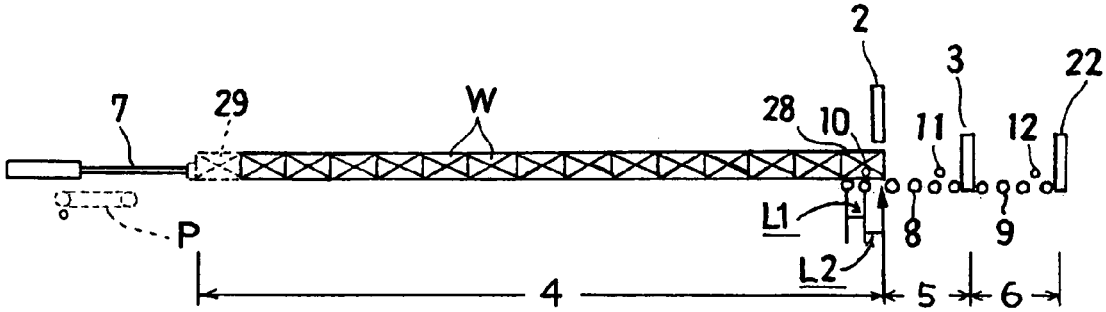

Referring to FIG. 6, while carburizing proceeds in the heating zone 4, the partition door 2 separating the heating zone 4 from the cooling zone 5 is opened in response to a timer so that the new work 29 is supplied into the heating zone 4 by the tray pusher 7 and, simultaneously, the foremost work 28 which has been carburized in the heating zone 4 is led by the roller hearth 8 into the cooling zone 5.

As shown in FIG. 6, conveyance of the foremost work 28 to the cooling zone 5 until the foreface of the work 28 is detected by the work-detecting sensors 10, i.e., a stroke L1, is conducted by the tray pusher 7, the work-detecting sensors 10 being provided in the heating zone 4. Regarding the subsequent stroke L2, how much the tray pusher 7 proceeds is previously determined by pulse calculation, thereby reducing the length of the furnace.

In the drawing, P denotes a pulse detector for pulse-controlling the distance by which the tray pusher 7 proceeds. Although details are not illustrated, the pulse detector P includes a proceeding position-detecting mechanism that is operatively associated with the proceeding of the tray pusher 7.

Next, the reduction in the length of the furnace accomplished by the work conveyance method of the present embodiment will now be described.

Figure 19:
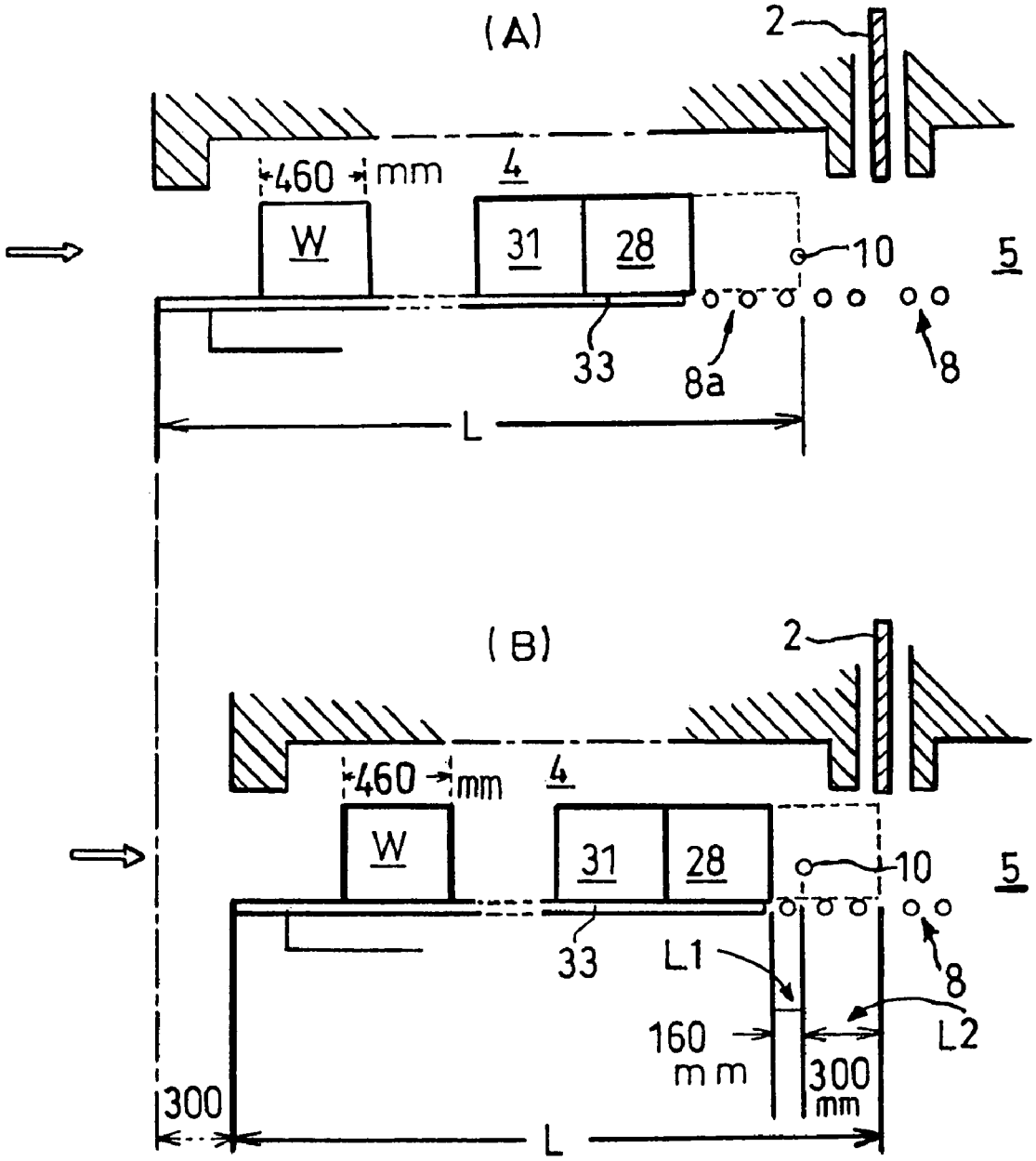
FIG. 19 is an explanatory view showing a work conveyance method from a quenching zone to a cooling zone.

In FIG. 19, (A) shows a general work conveyance method whereas (B) shows a work conveyance method according to the present embodiment shown in FIG. 6. In both conveyance methods, each optical work-detecting sensor 10 cannot be provided at the partition door 2 and thus must be provided inside the heating zone 4 which is disposed in front of the partition door 2.

In both work conveyance methods, it is required that while the foremost work 28 be transferred to the cooling zone 5, the subsequent work 31 be moved to a predetermined position in the heating zone 4, namely, to the rear end part of a conveyor rail 33. In the description for FIG. 19, the length of one block (one tray) of the work W is hypothetically 460 mm.

First, the general conveyance method shown in FIG. 19(A) will be described. In order to transfer the foremost work 28 to the cooling zone 5 and, simultaneously, to move the subsequent work 31 to the end part of the conveyor rail 33, a roller hearth 8*a* with at least a length of one block of the work W, i.e., 460 mm needs to be provided between the front end of the conveyor rail 33 and the work-detecting sensors 10.

On the other hand, with the work conveyance method shown in FIG. 19(B) according to the present embodiment, part of the roller hearth 8*a* included in the general conveyance method shown in FIG. 19(A) is not provided but the conveyor rail 33 extends there instead. Therefore, the length of the furnace is reduced by the length of the part of the roller hearth 8*a* that is replaced by the roller hearth 8. The reduction in length is shown on the entrance side of the furnace in FIG. 19(B).

More specifically, according to the present embodiment, the front end of the roller hearth 8 belonging to the cooling zone 5 resides inside the heating zone 4 by the length of one block of the work W from the partition door 2, which separates the heating zone 4 from the cooling zone 5, and the rear end of the conveyor rail 33 provided in the heating zone 4 is connected to the front end of the roller hearth 8 in order to transfer the work W. The length of the roller hearth 8 of the cooling zone 5 is minimized inside the heating zone 4, thereby reducing the length of the furnace body.

According to the work conveyance method of the present embodiment shown in FIG. 19(B), in accordance with the normal operation of the tray pusher 7, the work W is moved along the conveyor rail 33 in the heated chamber for, e.g., 160 mm and the foreface of the foremost work 28 is detected by the work-detecting sensors 10 provided in the heating zone 4 (stroke L1).

Subsequently, in accordance with the pulse, which is previously calculated, the distance by which the tray pusher 7 proceeds is controlled and the work W is moved for 300 mm, which brings the foremost work 28 to a predetermined position on the roller hearth 8 (stroke L2). Thereafter, the proceeding of the tray pusher 7 is halted and the subsequent work 31 remains on the conveyor rail 33 to be carburized.

Figure 7:
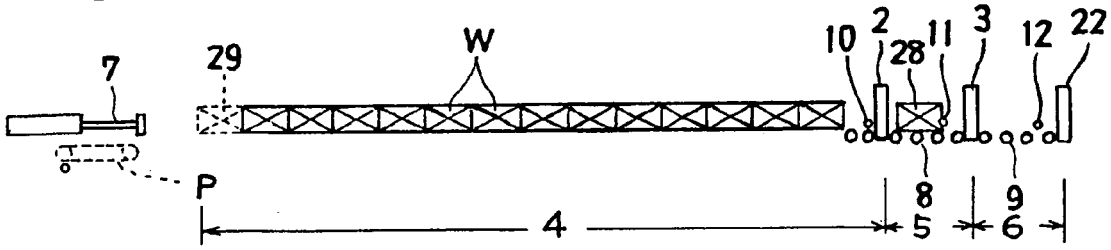

Referring to FIG. 7, while carburizing proceeds in the heating zone 4, a new work 29 is supplied into the heating zone 4 to be carburized and, simultaneously, the foremost work 28 is moved to a predetermined position in the heating zone 4 by the roller hearth 8. After that, the partition door 2 is closed and the foremost work 28 is cooled down. If necessary, the roller hearth 8 turns forward and backward so that rocking or inching is performed on the foremost work 28.

Figure 8:
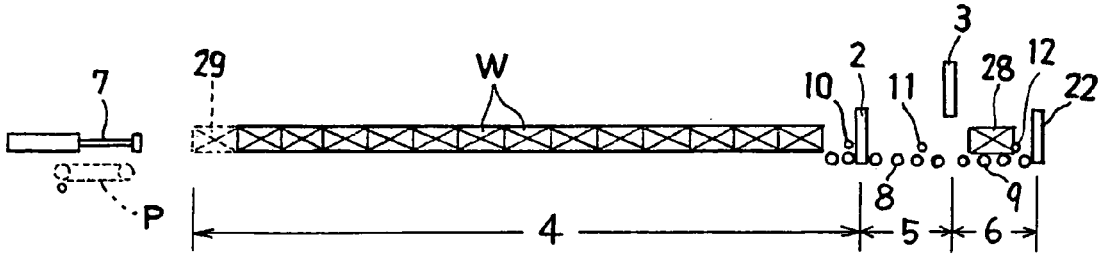

Referring to FIG. 8, while carburizing proceeds in the heating zone 4, cooling of the foremost work 28 is completed in the cooling zone 5 and the partition door 3 separating the cooling zone 5 from the quenching zone 6 is opened in response to the timer. Then, the roller hearth 8 and the roller hearth 9 are actuated so that the foremost work 28 is transferred to the quenching zone 6.

Figure 9:
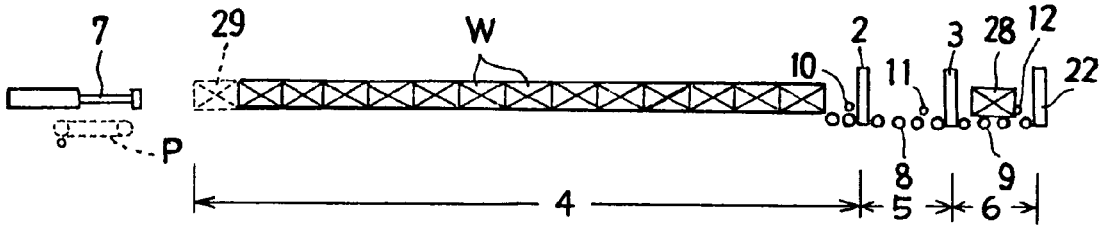

Referring to FIG. 9, while carburizing proceeds in the heating zone 4, the partition door 3 separating the cooling zone 5 from the quenching zone 6 is closed and the foremost work 28 is held in the quenching zone 6 at soaking temperature.

Figure 10:
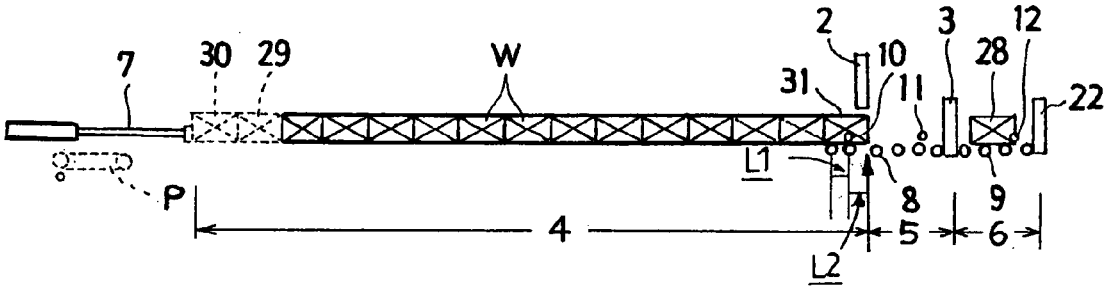

Referring to FIG. 10, while carburizing proceeds in the heating zone 4, the partition door 2, which separates the heating zone 4 from the cooling zone 5, is opened in response to the timer and a new work 30 is supplied into the heating zone 4 by the tray pusher 7. Simultaneously, the foremost work 31 in the heating zone 4 is led by the roller hearth 8 to be transferred to the cooling zone 5. This step is the same as the step shown in FIG. 6 except that the foremost work 28 is in the quenching zone 6.

Figure 11:
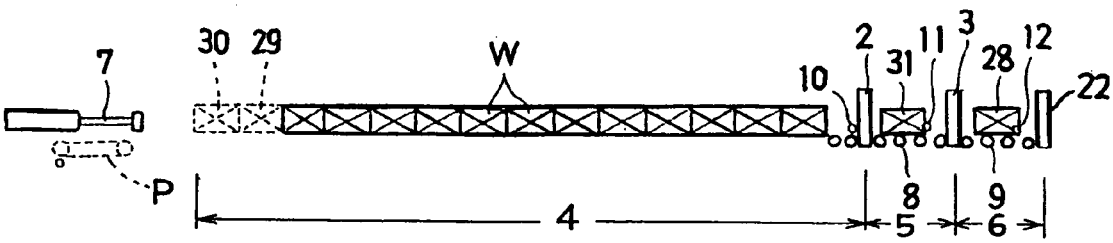

Referring to FIG. 11, while carburizing proceeds in the heating zone 4, the foremost work 31 in the heating zone 4 is transferred to the cooling zone 5. This step is the same as the one shown in FIG. 10 except that cooling is started in this step.

Figure 12:
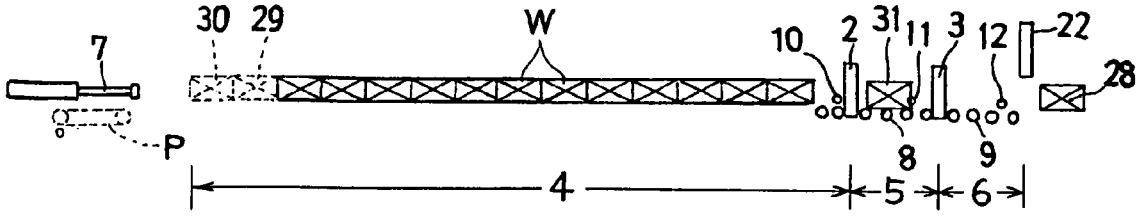

Referring to FIG. 12, the exit door 22 is opened and the foremost work 28 in the quenching zone 6 is transferred to a quench oil tank (not shown) by the roller hearth 9. Except for this, this step is the same as the one shown in FIG. 11.

Figure 13:
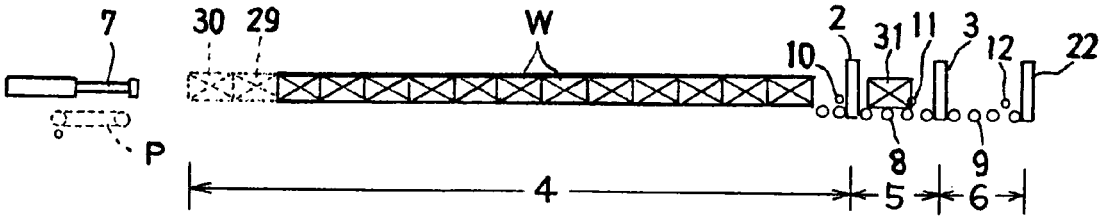

Referring to FIG. 13, the quenching zone 6 is emptied. Except for this, this step is the same as the step shown in FIG. 12.

Figure 14:
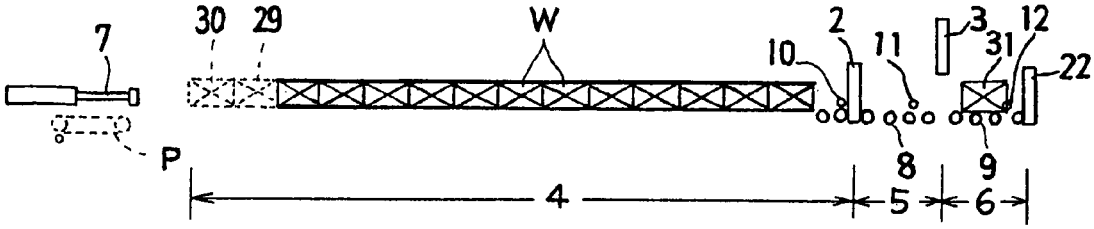

Referring to FIG. 14, while carburizing proceeds in the heating zone 4, cooling of the foremost work 31 is completed in the cooling zone 5 and the partition door 3, which separates the cooling zone 5 from the quenching zone 6, is opened in response to the timer. Simultaneously, the foremost work 31 is transferred to the quenching zone 6 by activating the roller hearth 8 and the roller hearth 9. This step is the same as the one shown in FIG. 8.

Figure 15:
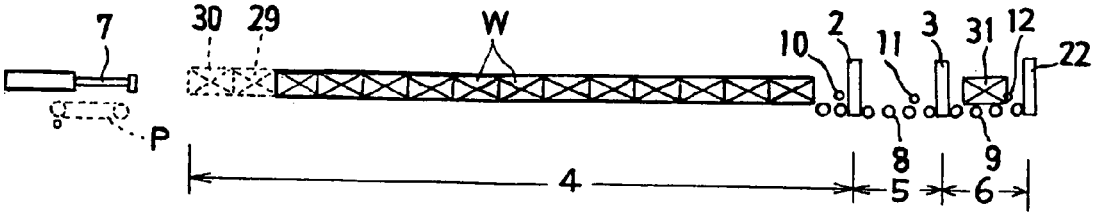

Referring to FIG. 15, while carburizing proceeds in the heating zone 4, the partition door 3, which separates the cooling zone 5 from the quenching zone 6, is closed in response to the timer and the foremost work 31 is held at a predetermined temperature in the quenching zone 6. This step is the same as the one shown in FIG. 9.

After the step shown in FIG. 15, the steps after FIG. 10 are repeated.

INDUSTRIAL APPLICABILITY

As has been described, according to the heat treatment furnace of the present embodiment, the control over the concentration of the atmosphere and the distribution of the quenching temperature are dramatically improved in the heating zone, the cooling zone, and the quenching zone. Furthermore, a temperature is decreased to the quenching temperature in one carburizing cycle and quenching is performed irrespective of the carburizing cycle, thereby reducing the lead time. This reduction in the lead time, in turn, reduces heating energy and atmospheric gas, resulting in cost reduction. Moreover, the installation space is reduced, leading to reduced costs.

The invention claimed is:

1. A heat treatment furnace wherein a heating zone (4), a cooling zone (5), and a quenching zone (6) are provided inside a linear furnace body in this order, the heating zone (4), the cooling zone (5), and the quenching zone (6) being separated by partition doors (2, 3), conveying means of a work (W) being a tray pusher (7) in the heating zone (4), conveying means of the work (W) comprising roller hearths (8, 9) in the cooling zone (5) and the quenching zone (6), the roller hearths (8, 9) being independently driven, wherein a front end of the roller hearth (8) belonging to the cooling zone (5) resides inside the heating zone (4) at the rear end of the heating zone (4), and wherein the front end of the roller hearth (8), which belongs to the cooling zone (5), resides inside the heating zone (4) by the length of one block of the work (W) from the partition door (2), which separates the heating zone (4) from the cooling zone (5), and a rear end of a work conveyor rail (33) provided in the heating zone (4) is connected to the front end of the roller hearth (8) in order to convey the work (W).

2. A heat treatment furnace wherein a heating zone (4), a cooling zone (5), and a quenching zone (6) are provided inside a linear furnace body in this order, the heating zone (4), the cooling zone (5), and the quenching zone (6) being separated by partition doors (2, 3), conveying means of a work (W) being a tray pusher (7) in the heating zone (4), conveying means of the work (W) comprising roller hearths (8, 9) in the cooling zone (5) and the quenching zone (6), the roller hearths (8, 9) being independently driven, wherein work-detecting sensors (10, 11, 12) are provided inside the heating zone (4), the cooling zone (5), and the quenching zone (6), respectively.

3. A heat treatment furnace wherein a heating zone (4), a cooling zone (5), and a quenching zone (6) are provided inside a linear furnace body in this order, the heating zone (4), the cooling zone (5), and the quenching zone (6) being separated by partition doors (2, 3), conveying means of a work (W) being a tray pusher (7) in the heating zone (4), conveying means of the work (W) comprising roller hearths (8, 9) in the cooling zone (5) and the quenching zone (6), the roller hearths (8, 9) being independently driven, wherein a wall of the furnace body has a layered structure including, from inside, a brick (13), a silica board (14), and a compact (15) composed of silica, titanium oxide, and inorganic fiber.

4. A heat treatment furnace wherein a heating zone (4), a cooling zone (5), and a quenching zone (6) are provided inside a linear furnace body in this order, the heating zone (4), the cooling zone (5), and the quenching zone (6) being separated by partition doors (2, 3), conveying means of a work (W) being a tray pusher (7) in the heating zone (4), conveying means of the work (W) comprising roller hearths (8, 9) in the cooling zone (5) and the quenching zone (6), the roller hearths (8, 9) being independently driven, wherein a front end of the roller hearth (8) belonging to the cooling zone (5) resides inside the heating zone (4) at the rear end of the heating zone (4), and wherein the front end of the roller hearth, which belongs to the cooling zone and is independently driven, resides inside the heating zone beyond the partition door, which separates the heating zone from the cooling zone, and a rear end of a work conveyor rail provided in the heating zone is connected to the front end of the roller hearth in order to convey the work.

5. A heat treatment furnace wherein a heating zone (4), a cooling zone (5), and a quenching zone (6) are provided inside a linear furnace body in this order, the heating zone (4), the cooling zone (5), and the quenching zone (6) being separated by partition doors (2, 3), conveying means of a work (W) being a tray pusher (7) in the heating zone (4), conveying means of the work (W) comprising roller hearths (8, 9) in the cooling zone (5) and the quenching zone (6), the roller hearths (8, 9) being independently driven, wherein a front end of the roller hearth (8) belonging to the cooling zone (5) resides inside the heating zone (4) at the rear end of the heating zone (4), and wherein the front end of the roller hearth, which belongs to the cooling zone, resides inside the heating zone by the length of at least one block of the work from the partition door, which separates the heating zone from the cooling zone, and a rear end of a work conveyor rail provided in the heating zone is connected to the front end of the roller hearth in order to convey the work.

* * * * *